United States Patent [19]

Leonard

[11] 4,359,216

[45] Nov. 16, 1982

[54] FLEXIBLE SHEET FEEDING MECHANISM

[75] Inventor: Gerard E. Leonard, Kernersville, N.C.

[73] Assignee: R. J. Reynolds Tobacco Company, Winston-Salem, N.C.

[21] Appl. No.: 227,579

[22] Filed: Jan. 23, 1981

Related U.S. Application Data

[63] Continuation of Ser. No. 64,147, Aug. 6, 1979, abandoned.

[51] Int. Cl.[3] ..... B65H 3/08

[52] U.S. Cl. ..... 271/107; 271/95

[58] Field of Search ..... 271/95, 100, 101, 106, 271/107, 30 A

[56] References Cited

U.S. PATENT DOCUMENTS

| | | | |
|---|---|---|---|
| 1,290,509 | 1/1919 | Chandler | 101/236 |
| 2,111,024 | 3/1938 | Donnellan | 271/95 X |
| 3,269,724 | 8/1966 | Lefiet | 271/107 |
| 3,736,213 | 5/1973 | Jorss | 271/95 X |
| 3,861,667 | 1/1975 | Jahme | 271/95 X |

*Primary Examiner*—Richard A. Schacher

*Attorney, Agent, or Firm*—Grover M. Myers; Joseph E. Root, III

[57] ABSTRACT

A flexible sheet feeding mechanism with a hopper for receiving parallel sheets and a suction pickup which has a simultaneous linear and angular reciprocating motion. The pickup separates the outside sheet of the hopper stack by applying suction near one edge. The linear and angular motion of the suction device then peels that sheet off of and away from the stack, feeding it into a set of friction rollers. The plane formed by the outside flexible sheet intersects the plane generated by the path of linear reciprocal movement.

4 Claims, 3 Drawing Figures

FLEXIBLE SHEET FEEDING MECHANISM

This application is a continuation of application Ser. No. 064,147 filed Aug. 6, 1979, and now abandoned.

TECHNICAL FIELD

This invention relates to a storage and feeding mechanism for feeding flexible sheets or blanks into a cartoning machine.

BACKGROUND OF THE INVENTION

In the cigarette manufacturing industry, there are a number of different types of cartoning machines which are used to carton ten packages of cigarettes in a single carton. In the past, the cartoning machine manufactured by Molins Limited, London, England has been utilized widely throughout the cigarette manufacturing industry. In the past several years, one of the primary objectives of the cigarette industry has been to increase production speeds and, thus, reduce costs. Manufacturers such as Molins Limited and Hauni-Werke GmbH have developed cigarette making machines with greatly increased production rates.

It is also desirable, as nearly as possible, to have production lines of cigarette making machine, a packaging machine and a cartoning machine set up on a 1:1:1 basis, but each of the different machines run at different unit per minute speeds. Therefore, it is almost impossible to set up a complete production line on a 1:1 ratio. For example, the new generation making machines have a greater making capacity than the previously used AMF packer manufactured by AMF Company, but these same making machines have insufficient capacity for the new generation of packers; for example, the G.D.-X.1 Cigarette Packer manufactured by G. D. Societa per Azioni from Bologna, Italy. For this reason, either two makers must be used in conjunction with a single G.D. packer running at full capacity or one high speed maker running at full capacity must be used in conjunction with two AMF packers. The problem with these hook-ups is that either the maker or the packer cannot be run at full capacity. For example, if the makers were run at full capacity, a single G.D. packer could not handle the full output; however, the increased output of the makers is not great enough for an additional packing machine, thus, one of the machines must be operated below capacity.

Steps have been taken to increase the output capacity of the AMF packers so that they can be hooked up on a one-to-one basis with the new generation cigarette makers. By using a one-to-one relationship between the new generation makers and the improved AMF packer, the boxers or cartoning machines cannot be hooked up in the usual two packer to one boxer ratio; thus, an improved boxer is essential.

There are generally two kinds of cartoning machines used in the tobacco industry today. They are the Molins boxer and the G.D. cartoner. There are problems associated with the blank feeding mechanisms of both machines by increasing the speed. For example, as the speed of the Molins boxer is increased, slippage between the feed mechanism suction cups and the blanks occur producing jam-ups and production line stoppages. The jam-ups are caused by misalignment or skewing of the carton blanks as they are fed into the folding section of the cartoning machine. The slippage appears to be due to the forward force applied to the blanks in the hopper.

The horizontal components of the weight of the blanks, which are on an incline, and the gravity pressure roll, which is positioned behind the blanks to force them forward, produces a relatively high friction force which must be overcome as the leading blank is slid from the pile. As the speed of the feed mechanism increases, the blanks are removed from the hopper pile at an accelerated rate so that there is an increased amount of shock and less positioning time for the suction cups. In addition, there is less time for vacuum build-up in the feed line and inside the suction cups. The problems cause the suction cups to slip on the blank, thus, producing a misaligned blank going into the feed section.

One possible solution would appear to be to reduce the forward force or the horizontal component of force on the blank being removed by reducing the weight of the blanks or the gravity roll. Although this solution might be feasible, it has been found that, even at the slower rates of speed, the hopper on the Molins boxer must be at least a quarter full before sufficient pressure is applied to the blank being removed before the suction cup of the feed mechanism will pick up the outside blank. Because of these limitations, the speed of the Molins boxer cannot be increased much further without extensive redesign of the entire feed section. The recently developed G.D. cigarette cartoning machine has generally overcome the slippage problem and provides some high speed reliability. The slippage problem is prevented by utilizing a feed section which remains in contact with the blank during the entire stroke of the machine, thus, requiring that the stroke be the same length as the blank. Since the outer blank is peeled away from the pile over its entire length, there is no opportunity for slippage to occur. The only problem with this solution is that there is a limitation placed on the speed of the machine because the stroke of the machine must be the length of the blank before the blank is removed from the pile to prevent problems with a friction force between the blanks.

Thus, there exists a need for a cartoning mechanism which will eliminate the slippage of the blank at high speed as well as permit a decrease in stroke length.

SUMMARY OF THE INVENTION

It is, therefore, an object of this invention to provide a flexible sheet feeding mechanism for a cigarette cartoning machine which can be operated at today's high speed production without producing slippage and skewing of the blanks.

Another object of this invention is to provide a cartoning machine wherein the various dimensional and positional relationships between the parts can be varied and, thus, produce a feeding mechanism which can be utilized with different size blanks and at increased production speeds.

Another object of this invention is to provide a cartoning machine which utilizes a linear and angular reciprocating movement in its suction pick-up means and a stroke length shorter than the blank.

These and other objects are accomplished by the present invention through the use of an apparatus for feeding flexible sheets comprising a hopper for receiving a plurality of parallel sheets and a suction means having both a linear and angular reciprocating movement for picking up an outside sheet of said pile, the plane generated by the path of the linear reciprocal movement of said suction means intersecting the plane of said outside sheet.

DESCRIPTION OF A PREFERRED EMBODIMENT

Figure 1:
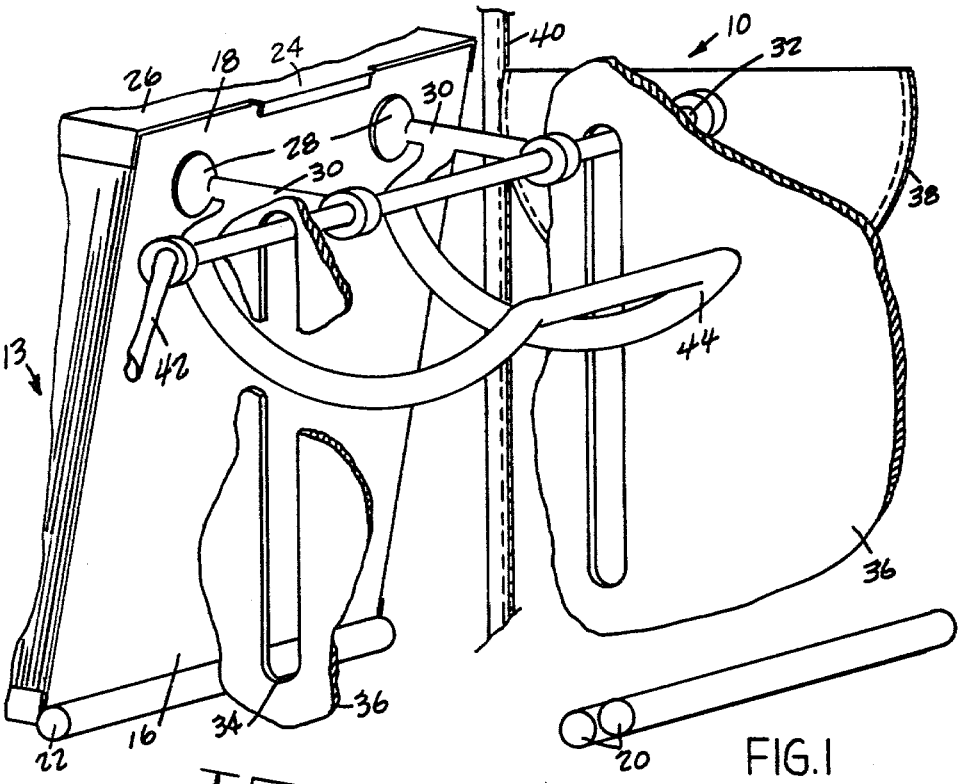
FIG. 1 is a perspective of the feed section of a cigarette cartoning machine according to the present invention.

In FIG. 1, the numeral 10 indicates a flexible sheet feeding mechanism and, in particular, a cigarette carton blank feeding apparatus having a hopper 12 for receiving and storing a plurality or pile of carton blanks 13 and a suction feeding device 14 which removes the leading or outside blank 16 of the pile. The suction feeding device inserts the upper edge 18 of each blank 16 into the in-feed rollers 20 of the carton folding machine (not shown). The hopper and suction feed device are so positioned that the edge 18 of the blank will be inserted into the nip of the in-feed rollers 20 without requiring movement of the rollers.

The leading blank 16 rests against a lower roller stop 22 suitably attached to the machine frame and a clip or stationary pins 24 attached to an upper transverse bar 26 of the hopper 12. The hopper is inclined slightly from the horizontal by an angle A which is sufficient to make the blank rest against roller stop 22 and clip 24 but not enough to force the blanks out of the hopper. In this preferred embodiment the angle A is normally between about 5° to 15°. It should be noted that the blank or sheet 16 must have enough stiffness so that they will not buckle or bend excessively when positioned in the hopper.

Figure 2:
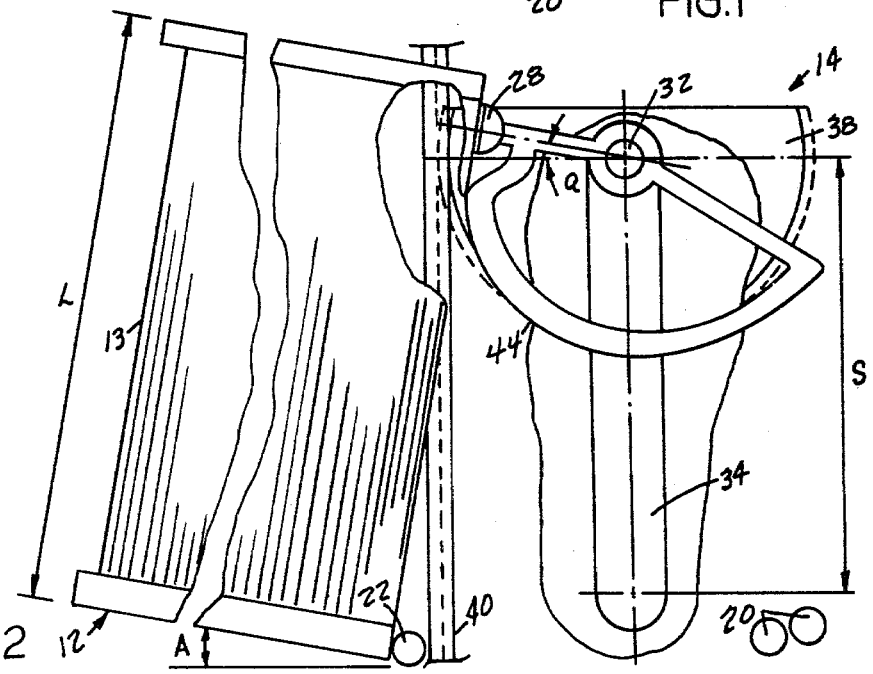
FIG. 2 is a schematic of the side view of the cigarette cartoning machine according to the present invention with the pick-up suction cup in the up position.
Figure 3:
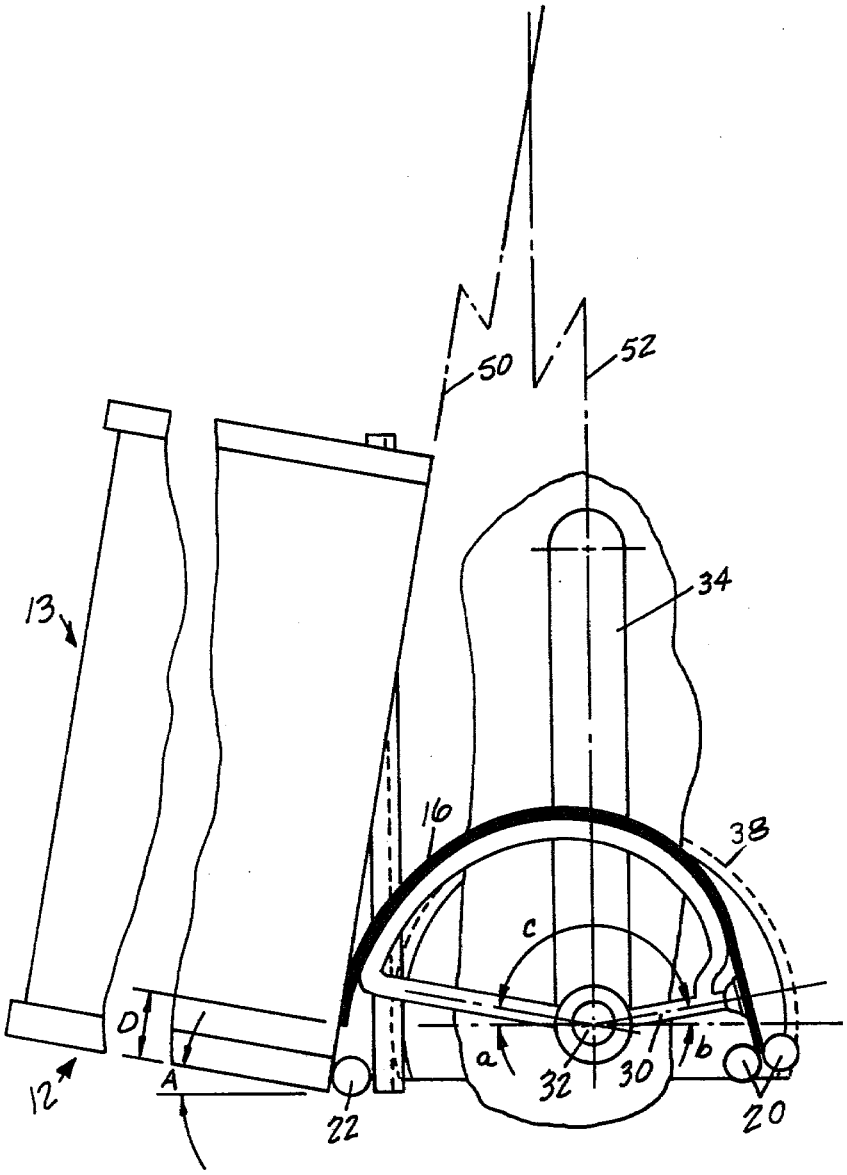
FIG. 3 is a schematic side view of the cigarette cartoning machine according to the present invention with the pick-up suction cup in the lower position.

Positioned adjacent to the hopper is the suction feeding device 14. A pair of suction cups 28 are attached to conduits 30 which are, in turn, suitably attached to and communicate with a hollow shaft 32. The shaft 32 extends through slots 34 and plates 36 which are suitably secured to the frame of the cartoning machine. Attached to the shaft are partial sprockets or gears 38 which mesh with a vertical rack 40 positioned adjacent to the gears and beside the hopper. Although one gear can be utilized and is shown in the drawings for clarity, it should be understood that, to insure a smooth stroke, a gear and rack may be utilized on each side of the hopper. The shaft drive (not shown) produces a reciprocated linear movement in the shaft in the slot 34 and, as the shaft moves linearly, it is reciprocated angularly about its axis by the gear 38 and track 40. Thus, shaft 32 has a simultaneous angular and linear reciprocating movement. As can be seen in FIGS. 2 and 3, the combination of angular and linear motion results in the suction cup 28 describing a cycloidal path from the upper end of the leading sheet in the hopper to the in-feed rollers 20.

A flexible tube 42 or other suitable means is attached to one end of the shaft and communicates with a vacuum source. The suction applied by the vacuum source is applied through the flexible conduit 42, shaft 32 and conduits 30 to the suction cups 28. The vacuum system can be controlled by any suitable means known in the art. However, a vacuum system should operate so that a suction is applied when the suction cups 28 engage the surface of the leading blank 16 and continue until the leading edge of the blank is engaged by the pinch rollers 20.

Although the curved guiderail 44 is not essential, it serves as a slide and support to keep the blank from bending and becoming entangled in the feeding mechanism as the blank is being drawn away from the feed mechanism by the pinch rollers.

FIGS. 2 and 3 illustrate the suction feed device 14 in its up and down position, respectively. The distance S that shaft 32 travels is referred to as the stroke of the suction feed device. It is desirable to have the trailing edge 46 of the blank 16 displaced slightly from the lower stop roll 22 to prevent the shock loading of the blank upon insertion of the blank into the pinch rollers 20. Shock loading sometimes causes slippage between the blank and the suction cups. As mentioned previously, this slippage produces misalignment or skewing of the blanks as they are fed into the folding section of the cartoning machine. The displacement D of the trailing edge 46 of the blank from rollers 22 is a function of several variables such as the suction arm radius $R_s$, the gear radius $R_g$, blank length L, stroke S, infeed angle a (which is the angle the suction arm is from the horizontal as the blank is picked up and is equal to angle A), the take-off angle b (which is the angle the suction arm is from the horizontal as the blank is inserted into the rollers) and shaft rotation c (which is the angle the shaft rotates). An example of a typical feed mechanism for cigarette cartons is as follows:

$R_s = 3''$ or 7.62 cm.
$R_g = 3''$ or 7.62 cm.
$a = 5°$
$b = 25°$
$c = 150°$
$L = 10.25''$ or 26 cm.

With the above values for these variables S equals 7.854" or 19.95 cm. and D equals 0.116" or 0.295 cm.

The displacement D (0.295 cm.) prevents slippage between the blank and the cups because the blank is completely out of the hopper and has no forces acting on it. The stroke S (19.95 cm.) which is less than the length L (26 cm.) of the blank permits the feeding device to operate at a higher rate of speed.

The reduction in the stroke can be accomplished because of the position of the hopper and, thus, the plane 50 of the loading blank with respect to the plane 52 generated by the line of linear movement of the shaft. As long as these planes are not parallel or intersecting, the stroke can be reduced.

From the above description and example, it can be seen that the feeding mechanism according to the present invention provides an angularly and linear moving suction feed element which can utilize a stroke shorter than the length of the blank with no slippage problem between the suction cup and the blank.

What I claim is:

1. In a flexible sheet feeding apparatus of the class having a hopper for receiving and storing flexible sheets and suction means for engaging, transporting and feeding said flexible sheets to a work station, wherein said suction means undergoes simultaneous linear and angular reciprocating motion to peel said flexible sheets from said hopper, the improvement comprising arrangement of said suction means with said hopper so that the plane generated by the path of linear reciprocating motion intersects the plane of the foremost sheet in said hopper at an acute angle; whereby the stroke of said linear motion is reduced, increasing the speed of operation of said apparatus.

2. Apparatus for feeding flexible sheets to a work station, comprising:

(a) a hopper for receiving a stack of flexible sheets;

(b) a suction feeding device, moveably mounted between said hopper and the processing station, including suction cups for engaging and transporting the flexible sheets; support means for carrying said suction cups; and vacuum means for introducing negative pressure to said suction cups; and (c) reciprocating means drivingly connected to said suction feeding device, adapted to impart simultaneous angular and linear reciprocating motion to said suction feeding device, so arranged that, (i) the linear reciprocating motion has a length less than the length of the flexible sheet;

(ii) the plane generated by the path of linear reciprocating motion intersects the plane of the foremost flexible sheet in said hopper at an acute angle; and (iii) said suction cup describes a cycloidal path within the space bounded by planes normal to the edges of said stack of flexible sheets.

3. Apparatus for feeding flexible sheets to a work station as recited in claim 1, wherein said reciprocating means comprises shaft drive means reciprocatingly connected to a partial gear, which gear meshes with a vertical rack gear; in which said suction feeding device is connected to said partial gear for simultaneous angular and linear reciprocating motion.

4. Apparatus for feeding flexible sheets to a work station as recited in claim 1, wherein said suction feeding device support means comprises a suction arm for carrying said suction cups, which suction arm communicates with said vacuum means for communicating negative pressure to said suction cups and guide means for supporting the flexible sheets during feeding.

* * * * *